US007342472B2

(12) United States Patent
Charvet

(10) Patent No.: US 7,342,472 B2
(45) Date of Patent: Mar. 11, 2008

(54) BISTABLE MICROMECHANICAL SWITCH, ACTUATING METHOD AND CORRESPONDING METHOD FOR REALIZING THE SAME

(75) Inventor: Pierre-Louis Charvet, Saint-Martin-le-Vinous (FR)

(73) Assignee: Commissariat a l'Energie Atomique, Paris (FR)

( * ) Notice: Subject to any disclaimer, the term of this patent is extended or adjusted under 35 U.S.C. 154(b) by 257 days.

(21) Appl. No.: 10/564,801

(22) PCT Filed: Jul. 26, 2004

(86) PCT No.: PCT/FR2004/001988

§ 371 (c)(1),
(2), (4) Date: Jan. 17, 2006

(87) PCT Pub. No.: WO2005/015594

PCT Pub. Date: Feb. 17, 2005

(65) Prior Publication Data

US 2006/0192641 A1 Aug. 31, 2006

(30) Foreign Application Priority Data

Aug. 1, 2003 (FR) ..... 03 09534

(51) Int. Cl.
*H01H 51/22* (2006.01)

(52) U.S. Cl. ..... 335/78; 200/181

(58) Field of Classification Search ..... 335/78
See application file for complete search history.

(56) References Cited

U.S. PATENT DOCUMENTS

| | | | | |
|---|---|---|---|---|
| 4,979,149 | A | 12/1990 | Popovic et al. | |
| 6,720,851 | B2 * | 4/2004 | Hallbjorner et al. | 335/78 |
| 7,053,736 | B2 * | 5/2006 | Nelson | 335/78 |
| 7,126,446 | B2 * | 10/2006 | Howell et al. | 335/78 |
| 7,268,653 | B2 * | 9/2007 | Bouche | 335/78 |
| 2002/0191897 | A1 | 12/2002 | Hallbjorner et al. | |
| 2003/0080839 | A1 | 5/2003 | Wong | |

OTHER PUBLICATIONS

Robert et al., "Intergrated RF-Mems Switch Based On a Combination of Thermal and Electrostatic Actuation," Transducers '03; The 12th International Conference on Solid State Sensors, Actuators and Microsystems, pp. 1714-1717{Jun. 8-12, 2003}.

* cited by examiner

*Primary Examiner*—Elvin Enad
*Assistant Examiner*—Bernard Rojas
(74) *Attorney, Agent, or Firm*—Oliff & Berridge, PLC

(57) ABSTRACT

A deformable suspension bridge is attached to a substrate by two legs arranged in such a manner as to transversally subdivide the bridge into a medial segment arranged between the legs and into two outwardly projecting peripheral segments. Peripheral actuators and medial actuators enable the peripheral segments and the medial segment to be respectively and independently deformed perpendicularly to the substrate. As a result, an electrical contact between a first conductive element formed on the substrate, while being situated between the bridge and substrate, and a second conductive element, which is integrally secured to the underside of the bridge, can be made or broken, the switch whereby taking two mechanically stable positions.

12 Claims, 4 Drawing Sheets

BISTABLE MICROMECHANICAL SWITCH, ACTUATING METHOD AND CORRESPONDING METHOD FOR REALIZING THE SAME

BACKGROUND OF THE INVENTION

The invention relates to a micromechanical switch, comprising a deformable suspension bridge, attached to a substrate by support means, and actuating means designed, from a first stable position of the switch, to deform the deformable suspension bridge so as to make an electrical contact between at least one first conductive element formed on the substrate, while being situated between the bridge and the substrate, and a second conductive element, integrally secured to the underside of the bridge.

STATE OF THE ART

As represented in FIG. 1, a micromechanical switch typically comprises a deformable suspension bridge 1 attached by support means 2 to a substrate 3. Actuators enable the suspension bridge to be deformed, so as to make an electrical contact between first conductive elements 5 formed on the substrate 3 and a second conductive element 6 integrally secured to the underside of the bridge 1. The actuators are for example formed by electrodes 4*a* and 4*b* respectively formed on the bridge 1 and on the substrate 3, an electrical control voltage being applied therebetween. The first conductive elements 5 are for example formed by two sections of a radio frequency line that are connected by the second conductive element 6. When the actuating means 4 are interrupted (cancelling of the control voltage), the bridge 1 returns to its non-deformed state, i.e. its stable position, and the electrical contact is broken. To maintain an electrical contact, it is then necessary to continue actuation, which may increase the electrical consumption of the switch. Moreover, if there is a problem on the control (or on the voltage), the electrical contact is no longer ensured.

On the contrary, a conventional household switch has two stable positions and the electrical contact remains respectively made or broken without a continuous power input. However, it is complicated to manufacture a bistable switch of this kind of microscopic size.

In a known microscopic bistable switch, a first conductive element is formed by a drop of mercury which is moved by means of electrostatic forces to make or break an electrical contact between two solid conductive elements. However, on the one hand, mercury is very toxic and, on the other hand, the drop moves with the slightest movement of the switch, which can give rise to spurious switching.

The document US 2002/191,897 describes a switch comprising a switching beam connected at its ends by supports fixed onto a substrate. The switch presents a first stable position corresponding to an open position of the switch. The switching beams are actuated by switching electrodes so as to deform the switching beam to make the switch move to a second position corresponding to the closed position of the switch. To keep the contact in this second position, the switching electrodes have to be kept powered. The switch also comprises reconfiguration beams arranged at the periphery of the switching beam, on one side of the latter or on both sides thereof. The reconfiguration beams are fixed to the substrate by means of rigid supports. The switch also comprises actuating elements operating in conjunction with the reconfiguration beams and designed to deform the latter independently from the switching beam. In a first case, when the switch is in its first stable position, deformation of the reconfiguration beam increases the distance between the switching beam and the electrode. In a second case, deformation of the reconfiguration beam causes return forces representative of the spring constants of the switch to occur within the switching beam. In the first stable position of the switch only, these reconfiguration means (reconfiguration beams and associated actuating elements) enable the voltage which will be necessary for switching of the switch to be configured and adjusted. The switching voltage does in fact depend either on the distance between the beam and electrode or on the value of the return forces generated by the deformation of the reconfiguration beams.

OBJECT OF THE INVENTION

It is an object of the invention to remedy these shortcomings and in particular to achieve a microscopic switch having two mechanically stable positions.

According to the invention, this object is achieved by the appended claims and more particularly by the fact that the support means are formed by two legs arranged between the bridge and the substrate in such a manner as to subdivide the bridge transversally into a medial segment located between the legs and two outwardly projecting peripheral segments comprising free ends, the actuating means comprising peripheral actuating means and medial actuating means enabling the peripheral segments and the medial segment to be respectively deformed perpendicularly to the substrate.

According to a method for actuating an electrical contact of a micromechanical switch according to the invention, the switch being in the first stable position, in a first phase, the medial segment and peripheral segments are simultaneously flexed in the direction of the substrate, by means of their respective actuating means, in such a manner as to make an electrical contact, then the peripheral actuating means are interrupted in a second phase in such a manner as to automatically make the peripheral segments move away from the substrate, the medial actuating means being interrupted in a third phase, the medial segment thus being automatically kept in the flexed position so as to define a second stable position of the switch wherein the electrical contact remains made.

It is also an object of the invention to provide a method for realizing a micromechanical switch according to the invention, characterized in that fabrication of the deformable suspension bridge on the substrate comprises:

- deposition of a peripheral sacrificial layer on the substrate, on each side of the first conductive element,
- deposition of at least one peripheral insulating layer on each peripheral sacrificial layer so as to cover the front surfaces and the side surfaces of the two peripheral sacrificial layers to form the peripheral segments and the legs,
- deposition of a medial sacrificial layer between the peripheral insulating layers, coming into contact with the adjacent side surfaces of the two peripheral insulating layers and covering the first conductive element,
- deposition, on the medial sacrificial layer, of a medial insulating layer coming into contact with each of the front surfaces of the two peripheral insulating layers so as to form the medial segment,
- etching of the peripheral side surfaces of the two peripheral insulating layers so as to delineate the peripheral segments,
- removal of the sacrificial layers.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PARTICULAR EMBODIMENTS

Figure 1:
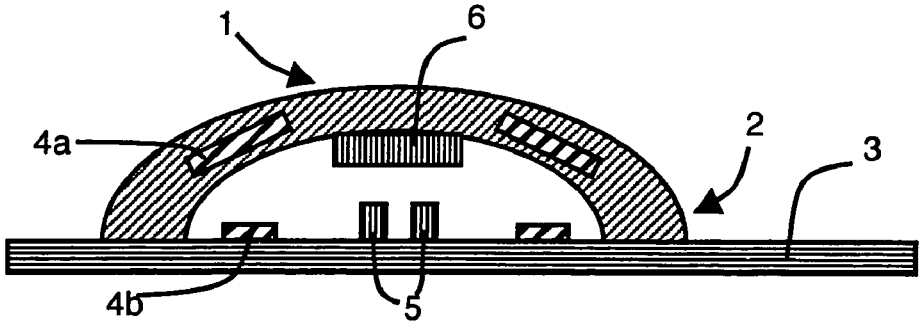
Figure 1 (Prior Art)
FIG. 1 shows a micromechanical switch according to the prior art.
Figure 2:
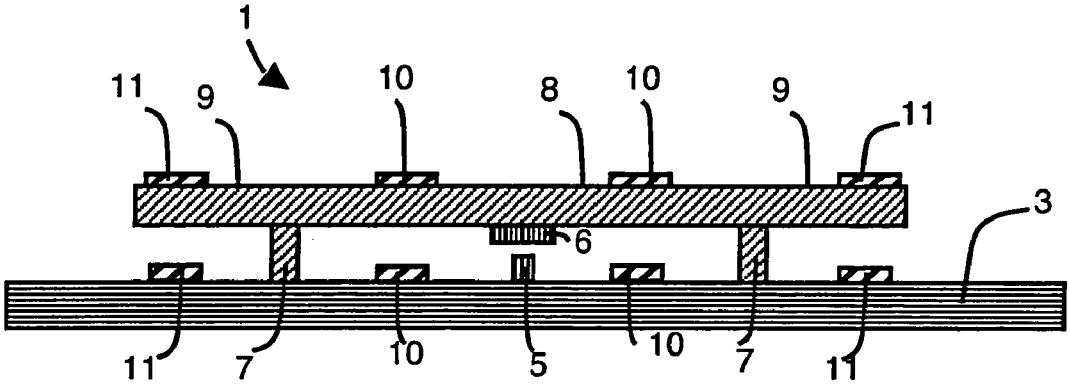
FIGS. 2 and 3 represent two particular embodiments of a micromechanical switch according to the invention.

The micromechanical switch represented in FIG. 2 comprises a deformable suspension bridge 1 attached to a substrate 3 by two legs 7 arranged between the bridge 1 and substrate 3 in such a manner as to subdivide the bridge 1 transversally into a medial segment 8 located between the two legs 7 and two outwardly projecting peripheral segments 9. Two medial electrostatic actuators 10 and two peripheral electrostatic actuators 11 respectively enable the medial segment 8 and the peripheral segments 9 to be deformed substantially perpendicularly to the substrate 3. The actuators 10 and 11 are formed by electrodes respectively formed on the substrate 3 and on the medial segments 8 or peripheral segments 9.

Starting from the first stable position, illustrated in FIG. 2, the actuators 10 and 11 enable the bridge 1 to be deformed in such a manner as to make an electrical contact between a first conductive element 5 formed on the substrate 3, between the bridge 1 and substrate 3, and a second conductive element 6, integrally secured to the underside of the bridge 1.

Figure 3:
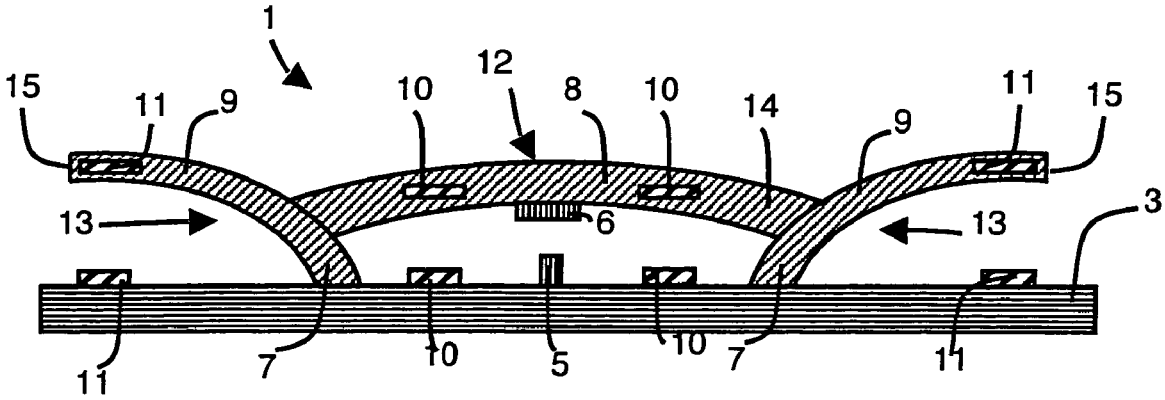

In FIG. 3, the peripheral actuators 10 are also in the rest position and the switch is in a first stable position. Whereas in FIG. 2, the medial segment 8 and peripheral segments 9 are formed by a single layer, in FIG. 3, a first curved layer 13 respectively forms a leg 7 and the associated peripheral segment 9, so that the legs 7 are inclined with respect to the substrate 3 and the peripheral segments 9 comprise inclined free ends 15 located away from the substrate 3. In FIG. 3, the medial segment 8 is formed by a second curved layer 14 and thus comprises a slightly raised central part 12. The actuators 10 and 11 are respectively integrated in the medial and peripheral segments.

Figure 4:
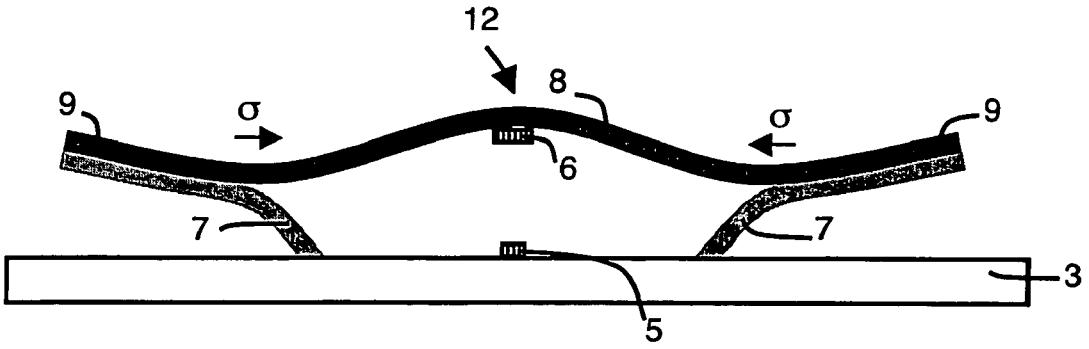
FIGS. 4 to 7 on the one hand, and 8 and 9 on the other hand, schematically illustrate respectively the different phases of making and breaking of an electrical contact of a micromechanical switch according to the invention.
Figure 5:
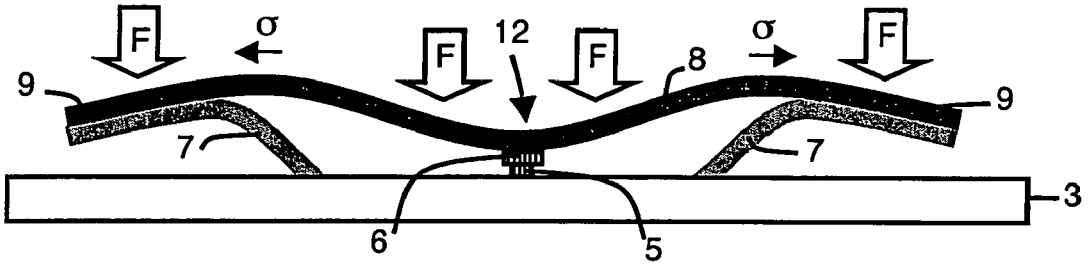
Figure 6:
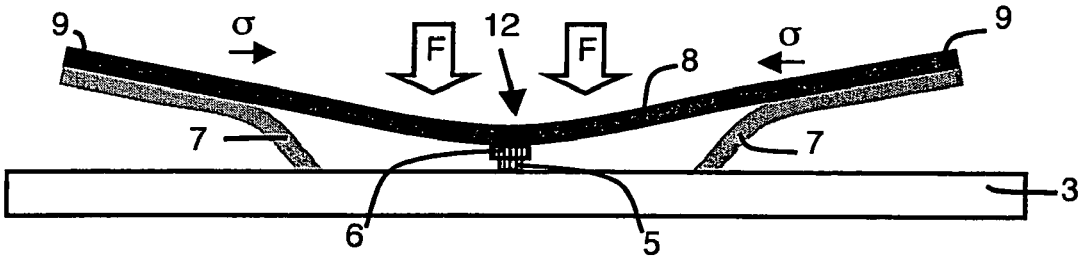
Figure 7:
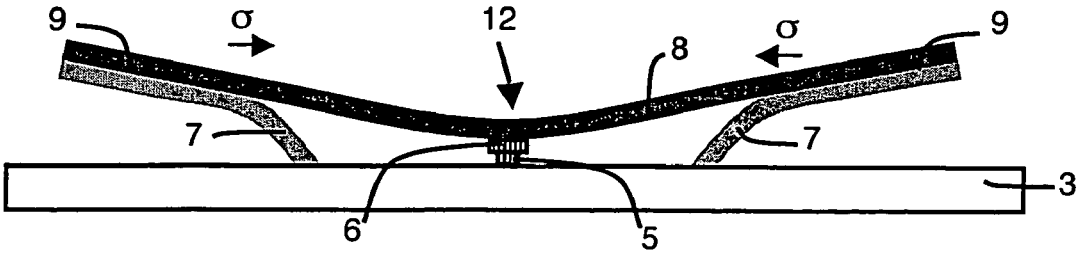

The switch can move from its first stable position, corresponding to breaking of the electrical contact (FIGS. 2 and 3), to a second stable position, corresponding to making of an electrical contact. FIGS. 4 to 7 schematically illustrate switching from the first stable position to the second stable position. In FIG. 4, the switch is represented in the first stable position, the actuators being at rest, the central part 12 of the medial segment 8 being raised and the peripheral segments 9 being inclined away from the substrate 3. Stresses $\sigma$ located at the level of the peripheral segments, represented by horizontal arrows in the figures, exert a compression force on the medial segment 8 in the longitudinal direction thereof and thus prevent the medial segment from leaving its raised position. In a first phase, represented in FIG. 5, the medial segment 8 and peripheral segments 9 are simultaneously flexed in the direction of the substrate 3, respectively by means of the medial actuators 10 and peripheral actuators 11. This enables the electrical contact to be made between the first conductive element 5 and the second 6 conductive element. During the first phase, actuation of the peripheral actuators 11 gives rise to stresses $\sigma$ exerting a tension force on the medial segment 8 in the longitudinal direction thereof (FIG. 5). Then the peripheral actuators 11 are interrupted in a second phase, represented in FIG. 6. This automatically causes the peripheral segments 9 to be moved away from the substrate 3 and, in this final position of the second phase, gives rise to compression stresses $\sigma$ on the medial segment 8 in the longitudinal direction thereof (FIG. 6). The medial actuators 10 are then interrupted in a third phase. The medial segment 8 is then automatically kept in the flexed position by compression stresses $\sigma$ exerted by the peripheral segments 9, thus defining a second stable position of the switch, represented in FIG. 7, in which the electrical contact remains made. The three successive phases of actuation thus enable the switch to be moved from its first stable position (FIG. 4) to its second stable position (FIG. 7).

Figure 8:
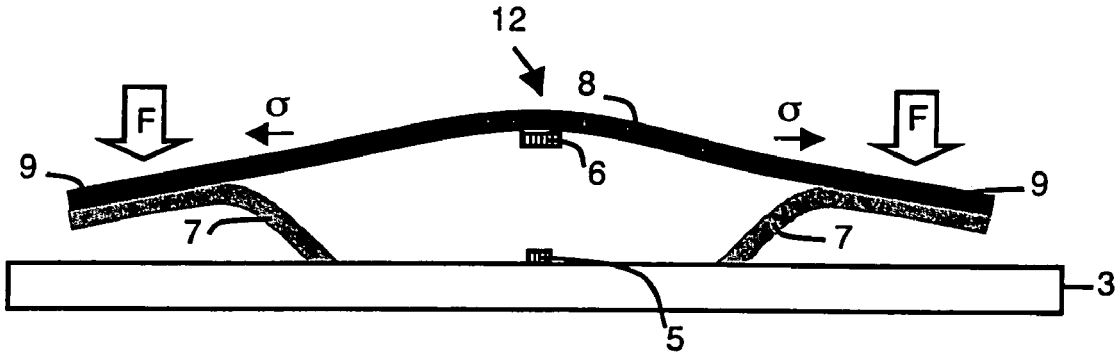
Figure 9:
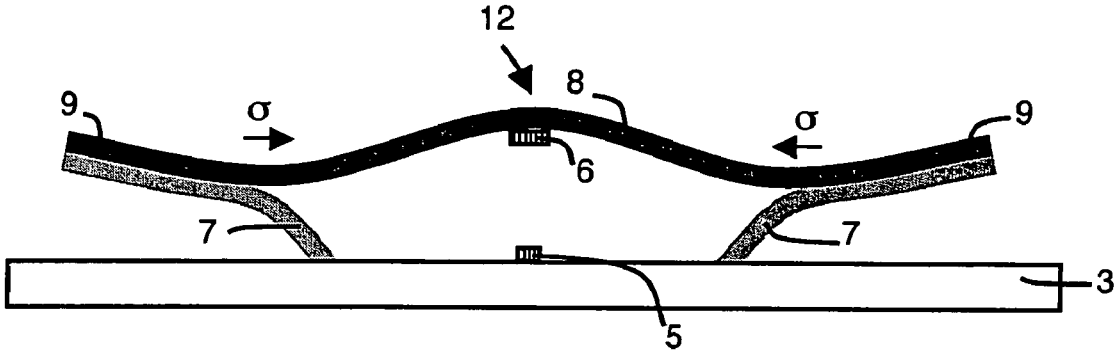
Figure 10:
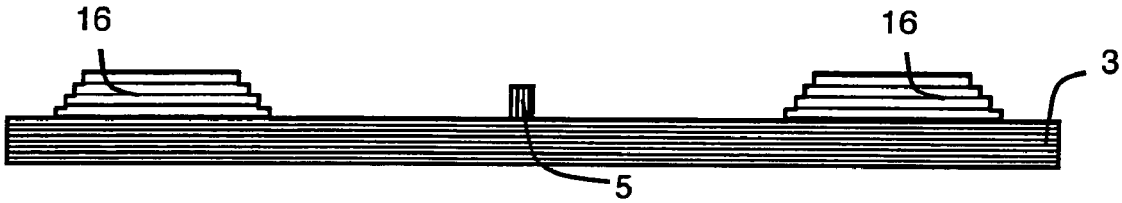
FIGS. 10 to 15 illustrate a method for realizing a micromechanical switch according to the invention.
Figure 11:
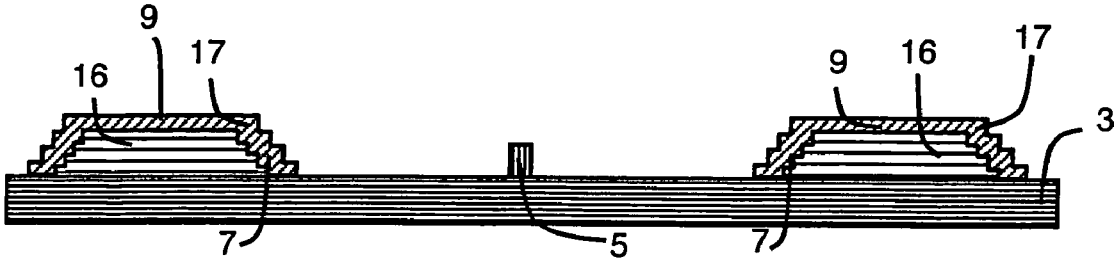
Figure 12:
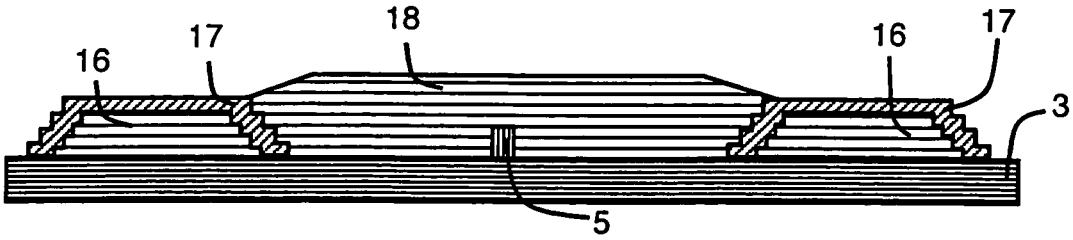

FIGS. 8 and 9 illustrate return of the switch from the second stable position to the first stable position. In a fourth phase, represented in FIG. 8, the peripheral segments 9 are in fact again flexed in the direction of the substrate 3, by means of the peripheral actuators 11. A mechanical tension stress $\sigma$ is exerted on the medial segment 8 in the longitudinal direction thereof, moving its central part 12 away from the substrate 3. The peripheral actuators 11 are then interrupted in a fifth phase, represented in FIG. 9, to move the switch to its first stable position, in which position the peripheral segments 9 are inclined away from the substrate 3.

The peripheral segments 9 are substantially in the same position (away from the substrate) in both the stable positions of the switch (FIGS. 4, 7 and 9) and only change position temporarily (FIGS. 5 and 8) when the switch is actuated.

The switch having two stable positions, the first position in which the electrical contact is broken and the second position in which the electrical contact is made, only switching from one position to the other consumes energy and the switch can, after it has been actuated, remain in each of these positions without any additional energy having to be provided.

Figure 13:
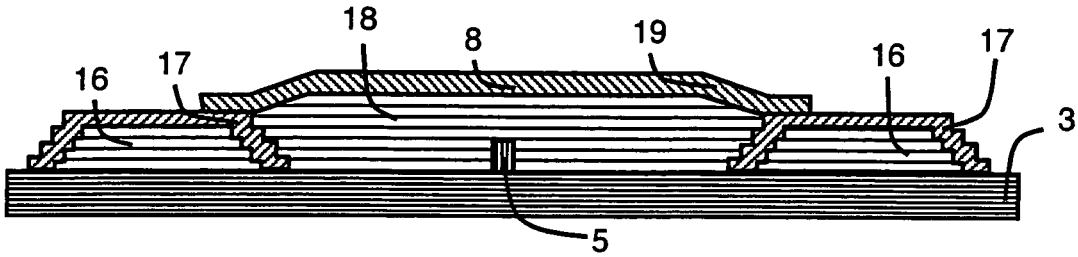
Figure 14:
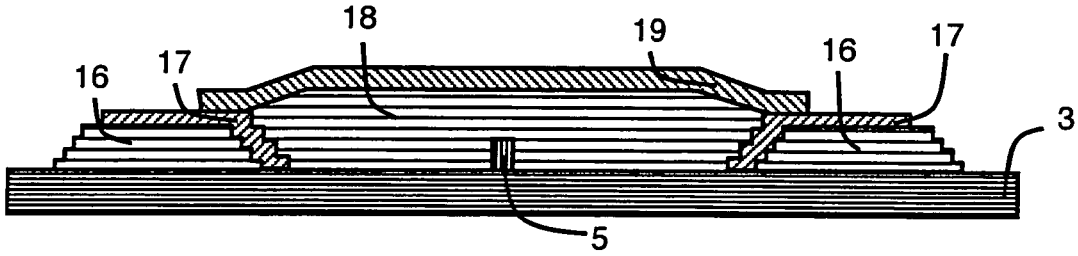
Figure 15:
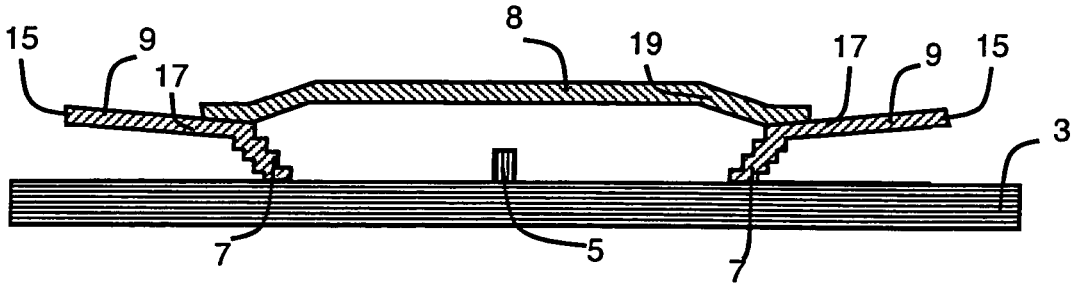

FIGS. 10 to 15 illustrate a method for realizing a micromechanical switch according to the invention. For the sake of clarity, the fabrication steps of the electrodes constituting the actuators 10 and 11 are not represented. Fabrication of the deformable suspension bridge 1 on the substrate 3 then comprises at least the following steps. In a first step, represented in FIG. 10, a peripheral sacrificial layer 16 is deposited on each side of the first conductive element 5 conductive arranged on the substrate 3. Then, in a second step represented in FIG. 11, at least one peripheral insulating layer 17, for example made of silicon nitride, is deposited on each peripheral sacrificial layer 16. The peripheral insulating layers 17 cover the front surfaces and side surfaces of the two peripheral sacrificial layers 16. The side surfaces of the peripheral insulating layers 17 arranged facing the first conductive element 5 are designed to form the legs 7, and the front surfaces of the peripheral insulating layers 17 are designed to form the peripheral segments 9. Then, in a third step, represented in FIG. 12, a medial sacrificial layer 18 is deposited between the peripheral insulating layers 17. It comes into contact with the adjacent side surfaces of the two peripheral insulating layers 17 and covers the first conductive element 5. The fourth step consists in depositing a medial insulating layer 19 on the medial sacrificial layer 18. This insulating layer comes into contact with each of the front surfaces of the two peripheral insulating layers 17, which it can partially cover, to form the medial segment 8 (FIG. 13). In a fifth step (FIG. 14), etching of the peripheral side surfaces of the two peripheral insulating layers 17 then enables the peripheral segments to be delineated, so as to only keep the peripheral segment 9 and the legs 7. In a sixth step, the sacrificial layers 16 and 18 are removed (FIG. 15).

The peripheral insulating layer 17 can be a layer able to generate a compression stress on the medial segment 8 in the longitudinal direction of the medial segment 8 by a mechanical torque effect at the level of the peripheral segments 9. In order to obtain a torque effect, the peripheral insulating layer 17 can be deposited using a process fixing a stress state of the peripheral insulating layer 17. By means of a process of the "bifrequency plasma deposition" type, for example, a single layer presenting a stress gradient can be obtained. The required stress level can be obtained by adjusting the thickness of the deposited layer. It is also possible to deposit several peripheral insulating layers 17 on each peripheral sacrificial layer 16 to achieve a stress gradient compressing the medial segment 8 in the longitudinal direction thereof. A stacking of two layers can, for example, be achieved by a non-stressed layer deposited on a layer in compression, by a layer in tension deposited on a non-stressed layer or by a layer in tension deposited on a layer in compression. A stacking of three layers can, for example, be constituted by two layers in tension deposited on a layer in compression or by a layer in tension deposited on a non-stressed layer itself deposited on a layer in compression. A spring type effect is thus obtained.

Figure 16:
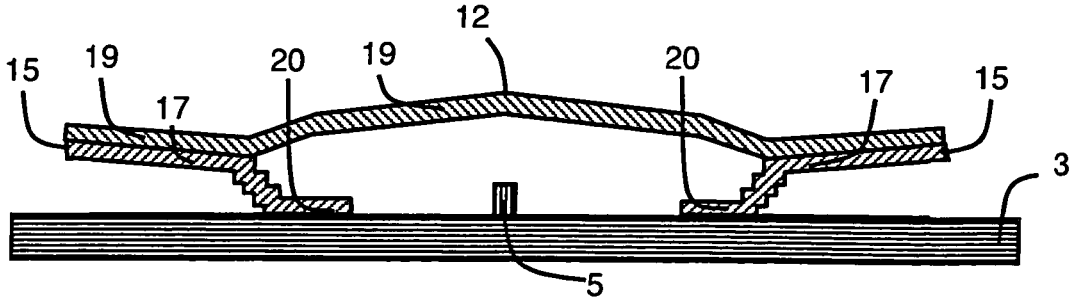
FIG. 16 represents an alternative embodiment of a micromechanical switch realized according to the method for realizing illustrated in FIGS. 10 to 15.

In a preferred embodiment, represented in FIG. 16, the medial insulating layer 19 covers the front surfaces of the peripheral insulating layers 17 over the whole length thereof, which amplifies the stresses between the two layers 17 and 19. Thus, after the sacrificial layers have been eliminated, the free ends 15 of the peripheral segments 9 and the central part 12 of the medial segment 8 automatically lift up away from the substrate. In an embodiment that is not represented, the electrodes of the peripheral electrostatic actuators 11 are respectively arranged between each peripheral insulating layer 17 and the associated medial insulating layer 19.

In FIG. 16, the peripheral insulating layers 17 each cover a part 20 of the front surface of the substrate 3 respectively arranged between the side surface of a peripheral sacrificial layer 16 and the first conductive element 5.

The invention is not limited to the particular embodiments represented. In particular, the actuators 10 and 11 can be constituted by any type of actuator i.e. by piezoelectric, thermal, magnetic actuators etc. . . . In the case of electrostatic actuators, the peripheral electrodes are preferably broader, for example by a factor three, than the medial electrodes, in a plane parallel to the substrate 3, enabling the control voltage of the peripheral actuators to be reduced. A switch according to the invention can be used in a matrix of switches or as a single switch. Such a switch can typically be used in telecommunication applications, in particular for radio frequency, terrestrial and space devices, in biomedical applications, relays, etc. . . .

The invention claimed is:

1. Micromechanical switch, comprising a deformable suspension bridge, attached by support means to a substrate, and actuating means designed, from a first stable position of the switch, to deform the deformable suspension bridge in such a manner as to make an electrical contact between at least one first conductive element formed on the substrate, between the bridge and the substrate, and a second conductive element, integrally secured to the underside of the bridge, switch wherein the support means are formed by two legs arranged between the bridge and the substrate in such a manner as to subdivide the bridge transversally into a medial segment located between the legs and two outwardly projecting peripheral segments comprising free ends, the actuating means comprising peripheral actuating means and medial actuating means enabling the peripheral segments and the medial segment to be respectively deformed perpendicularly to the substrate.

2. Switch according to claim 1, wherein the medial segment comprises a raised central part in the first stable position of the switch.

3. Switch according to claim 1, wherein the free ends are inclined away from the substrate in the rest position of the peripheral actuating means.

4. Switch according to claim 1, wherein the actuating means are formed by electrodes respectively formed on the substrate and on the peripheral and medial segments.

5. Switch according to claim 1, wherein the legs are inclined.

6. Method for actuating an electrical contact of a micromechanical switch according to claim 1, wherein, the switch being in the first stable position, in a first phase, the medial segment and peripheral segments are simultaneously flexed in the direction of the substrate, by means of their respective actuating means, in such a manner as to make the electrical contact, then the peripheral actuating means are interrupted in a second phase so as to automatically make the peripheral segments move away from the substrate, the medial actuating means being interrupted in a third phase, the medial segment thus being automatically kept in the flexed position so as to define a second stable position of the switch in which position the electrical contact remains made.

7. Method according to claim 6, wherein, the switch being in the second stable position, in a fourth phase, the peripheral segments are flexed in the direction of the substrate, by means of the peripheral actuating means, so as to exert a mechanical stress on the medial segment and to move the central part thereof away from substrate, the peripheral actuating means being interrupted in a fifth phase to move the switch to its first stable position.

8. Method for realizing a micromechanical switch according to claim 1, wherein fabrication of the deformable suspension bridge on the substrate comprises:

deposition of a peripheral sacrificial layer on the substrate, on each side of the first conductive element, deposition of at least one peripheral insulating layer on each peripheral sacrificial layer so as to cover the front surfaces and the side surfaces of the two peripheral sacrificial layers to form the peripheral segments and the legs, deposition of a medial sacrificial layer between the peripheral insulating layers, coming into contact with the adjacent side surfaces of the two peripheral insulating layers and covering the first conductive element, deposition, on the medial sacrificial layer, of a medial insulating layer coming into contact with each of the front surfaces of the two peripheral insulating layers so as to form the medial segment, etching of the peripheral side surfaces of the two peripheral insulating layers so as to delineate the peripheral segments, removal of the sacrificial layers.

9. Method for realizing a micromechanical switch according to claim 8, wherein the medial insulating layer is deposited at least partially on the front surface of the peripheral insulating layers.

10. Method for realizing a micromechanical switch according to claim 8, wherein the peripheral insulating layers are each deposited on a part of the front surface of the substrate respectively arranged between the side surface of one of the peripheral sacrificial layers and the first conductive element.

11. Method for realizing a micromechanical switch according to claim 8, wherein deposition of the peripheral insulating layers is performed so as to generate a stress gradient in the peripheral insulating layers.

12. Method for realizing a micromechanical switch according to claim 11, wherein deposition of the peripheral insulating layers is performed so as to generate, once the medial segment has been deposited, a compression stress on the medial segment in the longitudinal direction of the medial segment.

* * * * *